United States Patent [19]

Woog

[11] Patent Number: 4,834,849

[45] Date of Patent: May 30, 1989

[54] METAL RECOVERY METHOD AND APPARATUS

[76] Inventor: Gunter Woog, 5435 Bauers Dr., West Bend, Wis. 53095

[21] Appl. No.: 196,560

[22] Filed: May 20, 1988

[51] Int. Cl.[4] ..... C25C 1/00

[52] U.S. Cl. ..... 204/105 R; 204/109; 204/112; 204/114; 204/228; 204/250; 204/275; 204/290 R; 75/74; 75/89; 75/92

[58] Field of Search ..... 204/250, 109–114, 204/105 R, 228, 275, 290 R; 75/74, 89, 92

[56] References Cited

U.S. PATENT DOCUMENTS

| | | | |
|---|---|---|---|
| 1,572,253 | 2/1926 | Tilson | 204/67 |
| 3,236,753 | 2/1966 | Shantze et al. | 204/290 R |
| 3,244,612 | 4/1966 | Murphy | 204/290 R |

*Primary Examiner*—John F. Niebling
*Assistant Examiner*—David G. Ryser
*Attorney, Agent, or Firm*—Fuller, Puerner & Hohenfeldt

[57] ABSTRACT

An apparatus for recovering a conductive metal from a liquid which contains that metal, and a method for recovering that metal using that apparatus. The apparatus includes a generally closed non-metallic container defining a cavity, for containing the liquid. A first electrode is supported and affixed within the cavity. A second electrode is composed of a thin film applied to the inside surface of the container, the film including as its main constituent the same metal as that to be recovered from the solution. Finally, a power supply is electrically connected, positive to the first electrode and negative to the second electrode, thus causing the metal from the solution to be deposited on the film electrode, lining the inside surface of the container with the metal to be recovered. The disclosed method includes continuously circulating metal-containing liquid into the container and removing demetalized solution from the container. Because the container is disclosed to be constructed of material, such as plastic, which will not contaminate the metal during smelting, the entire container can be placed in a smelting furnace on completion of the demetallizing operation, eliminating a messy and wasteful metal removal step.

19 Claims, 1 Drawing Sheet

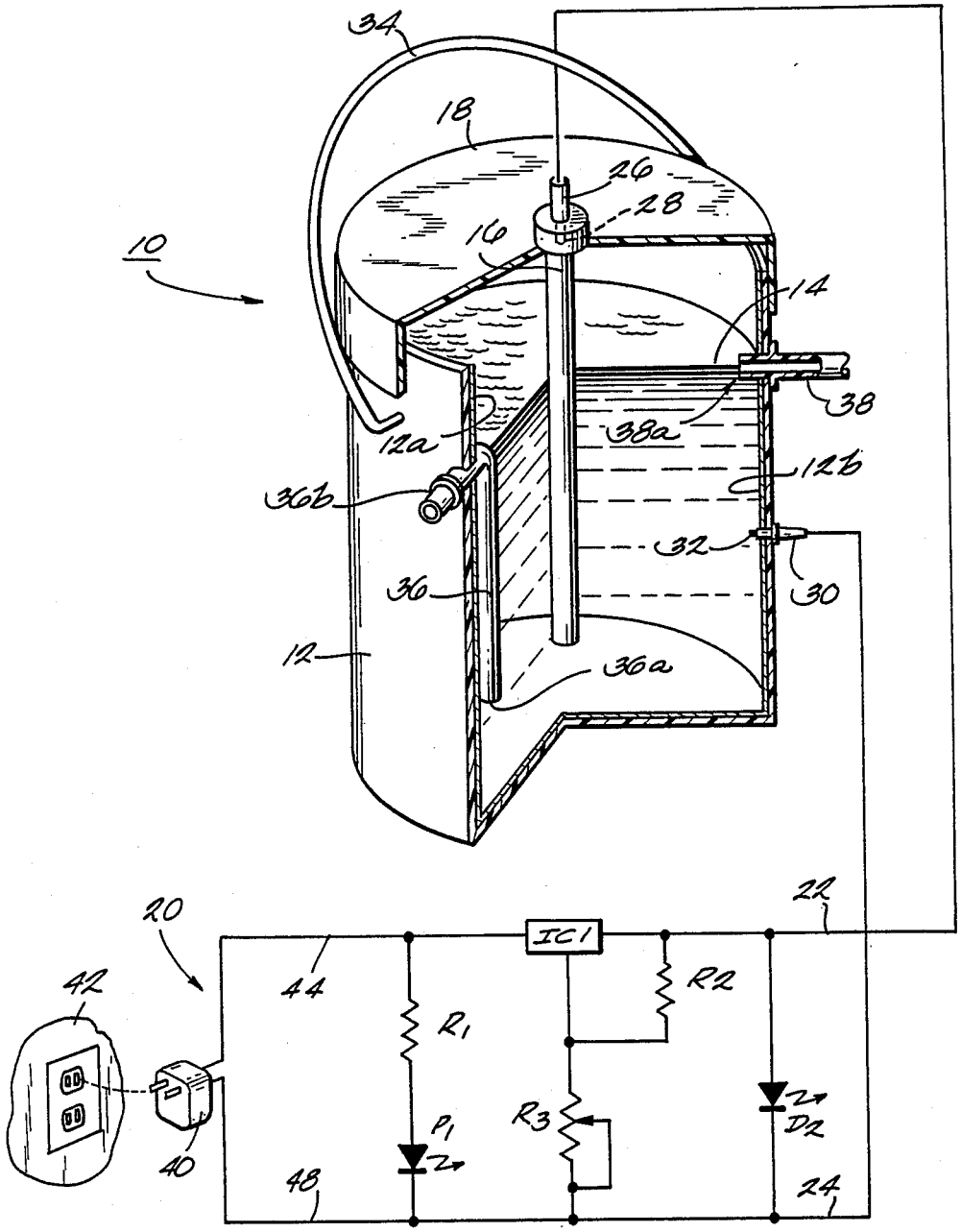
34
18
26
28
10
16
14
38
38a
12a
12b
36b
32
30
36
12
36a
20
22
IC1
42
44
R1
R2
R3
P1
D2
40
48
24

METAL RECOVERY METHOD AND APPARATUS

BACKGROUND OF THE INVENTION

This invention relates to methods and apparatus for recovering metals from liquid solutions, and in particular to methods and apparatus relating to recovery of silver from fixer solutions by disposable cells, with no moving parts and having an extremely high efficiency.

Up to the present time, recovery of conductive metals from solution, and particularly recovery of silver from fixer solutions, has been a relatively expensive process, requiring substantial mechanism and moving parts, as well as close supervision or complex computer controls, to accomplish. This is because the recovery process is electrolytic in nature, and the reaction if not closely monitored can cause sulfiding, damage to the solution and loss of silver. Hence continuous agitation is required as well as close control of the current being supplied to the reaction.

For instance, X-Rite Company offers a number of silver recovery systems, all of which include some type of means for agitating the solution. Further, most of the systems offered by X-Rite have a cathode which is coiled, thus having a relatively small surface area.

Similarly, Roconex Corporation manufactures a number of lines of silver recovery systems and markets them under the "Rotex" trademark. All of these systems include some type of agitation, generally with a rotating cathode which must then be removed from the recovery unit and cleaned, and later reinstalled and reused.

Moreover, all of the systems referred to above are relatively expensive, and there is a need in the marketplace for systems which are less expensive and mechanically simpler, since mechanical simplicity brings with it a high degree of reliability.

This invention relates to improvements to the apparatus described above and to solutions to some of the problems raised thereby.

SUMMARY OF THE INVENTION

The invention relates to an apparatus for recovering a conductive metal from a liquid which contains that metal, and to a method for recovering that metal using that apparatus. The invention is particularly well suited for recovery of silver from photographic fixer solutions. The apparatus includes a generally closed non-metallic container defining a cavity, for containing the liquid. A first electrode is supported and affixed within the cavity. A second electrode is composed of a thin film applied to the inside surface of the container, the film including as its main constituent the same metal as that to be recovered from the solution. Finally, power supply means are electrically connected to the electrodes so as to result in the first electrode being an anode and the second electrode being a cathode, thus causing the metal from the solution to be deposited on the second, film electrode, lining the inside surface of the container with the metal to be recovered.

The invention further includes means for circulating metal laden liquid, that is, liquid containing the metal in solution, into the container and for removing demetalized solution from the container. This circulating means includes a liquid introduction tube for introducing the metal-containing liquid near the bottom of the container and a liquid drain tube at about the top of the fluid level for drawing off the demetalized solution in an overflow manner.

The invention requires no agitators or other moving parts, because the current density supplied by the power supply is low, on the order of about 1.5 milliamperes per square inch. The current density can be this low and still process a substantial volume of liquid because of the large surface area of the cathode, that is, the entire interior surface of the container. The recovery operation is further facilitated by the fact that the metal recovered thereby is not required to be removed from the cathode, because the container itself is disposable, constructed from materials such as plastic which can be added to the smelting furnace without contaminating the smelting operation.

The method of the invention includes providing a disposable, electrically insulating container for containing metal-containing solution and applying a thin film of the metal to the inside surface of the container. An electrode is affixed within the container so that it is immersed in the liquid and insulated from film on the inside surface of the container. The voltage potential of the electrode over that of the thin film is then raised to about 1.5 volts, thereby causing the metal in the solution to be electrolytically deposited on the film and to build up thereon. This voltage causes a current density between the electrode and the film of about 1.5 milliamperes per square inch.

Other objects and advantages of the invention will become apparent hereinafter.

DESCRIPTION OF THE DRAWING

The drawing figure is a sectional view, partially schematic, especially with respect to the electrical control circuit, of a metal recovery apparatus constructed according to one embodiment of the invention.

DESCRIPTION OF THE PREFERRED EMBODIMENT

While the invention is applicable to removal of any type of conductive ionic metal in solution, it is particularly well suited to an application wherein silver is removed from photographic fixer solutions. The following description will refer to that silver removal application as exemplary, but it should not be considered as limiting the intended scope of the invention.

Referring now to the drawing figure, an apparatus 10 constructed according to one embodiment of the invention includes a container 12, containing an amount of fixer solution 14. The fixer solution 14 is a solution in which a ionic silver is dissolved. The entire inner surface **12*a* of the container is coated with a very thin film 12*b* of silver, the metal to be removed from the solution, such as by spray painting. The actual thickness of the film 12*b* as applied is not critical, as will be shown presently, as long as the interior surface of the container 12** is evenly coated sufficiently thick to conduct electricity. The thickness is commonly on the order of 1 mil. The material of the film may be generally any type of paint or other sprayable film containing silver, such as Acrylic 1, Part No. 73-00025, from Tecknit EMI Shielding Products, or E-Kote 3040 from ACME Conductive Coatings.

An electrode 16 is suspended near the center of the container, reaching substantially into the solution 14. This electrode 16 can be of any suitable and readily available material for such an electrode, such as carbon/graphite rod material. For ease of assembly and mounting of the electrode 16 to the container, the electrode can be mounted in the center of a cover 18, which is attached to the top of and closes the container 12. Preferably the cover 18 is formed of insulative material so as to insulate the electrode from the thin film 12*b*. The electrode 16 thus mounted reaches downward into the solution 14 for the majority of its length.

The apparatus 10 further includes a power supply 20 for providing energy for an electrolytic reaction to plate the ionic silver out of the fixer solution 14. This power supply 20 is preferably a 1.5 volt DC power supply, having a positive pole 22 and a negative pole 24. The electrode 16 is electrically connected to the positive pole 22 of the power supply 20, preferably by a positive connector 26, which fits into a receptacle 28 provided for that purpose at the top of electrode 16. Similarly, the thin film 12*b* coating the inside surface 12*a* of the container 12 is preferably electrically connected to the negative pole 24 by a negative connector 30 which fits into a receptacle 32 provided for that purpose. Hence the electrode 16, being connected to the positive pole of the power supply 20, is the anode for the electrolytic reaction, while the thin film 12*b* in effect acts as another electrode, becoming the cathode for the electrolytic reaction because of its connection to the negative pole of the power supply.

In the simplest mode of operation of the apparatus 10, then, an amount of fixer liquid 14 is placed in the container 12, and the cover 18 carrying the electrode rod 16 is placed on top of the container to close it. The electrode 16 and the film 12*b* are then connected to the power supply 20 and the electrolytic reaction begins. During the electrolytic reaction, silver from the solution 14 is deposited on the silver film 12*b* until all or a suitable amount of the silver is plated out of the solution. As the silver builds up on the film 12*b*, the cathode in effect increases in thickness, improving its performance. This is the reason that the original thickness of the film 12*b* is not critical, since it increases as the reaction progresses. Because of the relatively large surface area of the cathode film 12*b* with respect to the anode electrode 16, the current density will be extremely low, on the order of 1.5 milliamperes per square inch. Hence the apparatus 10 may run relatively unattended, since it is clear that the danger of sulfiding and/or damage to the solution, which problem is carefully and expensively controlled and guarded against in the prior art, is very remote at this low current density level. When a sufficient amount of silver has plated out, the power supply 20 may be disconnected and the electrode 16 and the liquid 14 removed.

The used container 12 may then be placed in its entirety, including the cover 18, in a silver smelting furnace (not shown) to refine the silver for reuse. This is a major advantage of the present invention. In most presently existing silver recovery devices, the deposited silver must be somehow removed from the cathode before smelting, whether by scraping or some other physical means or process. This can be a difficult, expensive and dangerous job. Moreover, some silver is inevitably lost in the process. In order that the container 12 may accompany its contained silver into the smelting furnace, it is required to be made entirely of some material that easily refines out of the molten silver in the smelting process, such as a common plastic pail. Of course a handle 34 may be provided for ease of handling the container 12, but if it is of a metal containing copper, such as stainless steel, or some other metal which does not easily refine out of silver, it must be removably attached to the container, so that it can be removed prior to placement of the container in the smelting furnace, and even reused, as is the electrode 16. Preferably, however, it is simply conventional iron or zinc-plated (galvanized) iron, for low cost.

While it is possible to use the apparatus 10 as described above in "batch mode", it is more efficient to use it in "continuous" mode, as will now be described. In continuous mode, silver-containing solution is constantly being circulated into the container 12, and de-silvered solution is constantly being removed. In the preferred embodiment as shown in the figure, the silver-containing solution is continuously introduced into the container 12 by means of a liquid introduction tube 36 which has its outlet 36*a* near the bottom of the container. To enhance flow, the liquid introduction tube 36 may also include a vent portion 36*b* which extends upwardly above the surface of the liquid 14. As silver is removed from the solution, the solution becomes lighter, rising to the top of the liquid 14 in the container 12 in a naturally occurring phenomenon referred to as "stratified transport". The solution at the top of the liquid, then, will be relatively more desilvered compared to that at the bottom of the liquid. This relatively de-silvered solution at the top is continuously removed from the container 12 by a liquid drain tube 38 the inlet 38*a* of which is located in the sidewall of the container at the level of the top of the liquid. By proper relative placement of the source of the silver-containing solution, above the container 12, and of the reservoir of relatively de-silvered solution, below the container 12, any necessity for pumps or other mechanically powered devices to move the solution is avoided, since the solution will move by siphoning. Further, since the relatively de-silvered solution may not be completely de-silvered from one pass through the apparatus 10, it may be desirable to connect a number of such apparatus together serially, so as to achieve the greatest possible silver extraction rate.

Both tubes 36 and 38 are preferred to be of plastic in order to be consistent with the objective, referred to above, that the entire container 12 may be placed in the smelting furnace when sufficient silver has been deposited.

Because of the extremely low current density allowed by the present invention, as mentioned above, the power supply 20 may be a generally conventional plug-in module type, as shown. As an additional aid in controlling and ensuring the integrity of the de-silvering reaction, the power supply 20 may also include certain additional features. In particular, in one embodiment of the present invention, the power supply 20 first includes a generally conventional transformer module 40, which plugs into a conventional 110 volt or 220 volt electrical outlet 42 and outputs 5 volts DC, up to one amp, via a positive lead 44 and a negative lead 44. A calculator-type transformer module with these characteristics is particularly well suited for this application. Connected between the two leads are a current limiting resistor R1 and a light emitting diode D1 connected in series. The purpose of the diode D1 is to indicate that the transformer module 40 is indeed receiving power from the outlet 42. Hence, whenever the outlet 42 is supplying power, the diode D1 is lit. Also connected to the positive lead 44 is a first lead of a voltage regulator IC1. The anode, or electrode 16, of the apparatus 10 is connected to a second lead of IC1. Finally, a third lead of IC1 is connected to the second lead by a resistor R2 and, via a potentiometer R3, to the negative lead 46 of the power supply transformer module 40. The purpose of the described arrangement of the voltage regulator IC1 and resistors R2 and R3 is to ensure that the current passing to the electrode 16 remains extremely low as described above. The potentiometer R3 allows adjustment of the circuit for tolerances of the components and for various sizes of containers 12. Preferably potentiometer R3 would be adjusted so as to provide 1.5 volts DC to the electrodes 12*b* and 16, resulting in the extremely low current density set forth above. Finally, flashing light emitting diode D2 is connected between the anode and cathode of the electrolysis circuit, that is, between the positive connector 26 and the negative connector 30. This diode D2 will flash if there is no current passing between the electrode 16 and the film 12*b*, thus acting as an indicator of the integrity of the electrolysis circuit.

While the apparatus hereinbefore set forth is effectively adapted to fulfill the aforesaid objects, it is to be understood that the invention is not intended to be limited to the specific preferred embodiment of metal recovery method and apparatus set forth above. Rather, it is to be taken as including all reasonable equivalents within the scope of the following claims.

I claim:

1. An apparatus for recovering a conductive metal from a liquid containing said metal in solution, said apparatus comprising:

a generally closed non-metallic container defining a cavity, for containing said liquid, said container being constructed of an easily refinable material when smelted with said metal;

a first electrode supported and removably affixed within said cavity;

a second electrode comprising a thin film applied to the inside surface of said container, said film including said metal to be recovered, power supply means electrically connected to said electrodes so as to result in said first electrode being an anode and said second electrode being a cathode, thus causing said metal to be deposited on said second electrode, lining the inside surface of said container with said metal.

2. An apparatus as recited in claim 1 further comprising means for circulating said liquid into and out of said container.

3. An apparatus as recited in claim 2 wherein said circulating means includes:

a liquid introduction tube having an inlet outside said container and an outlet within said container near the bottom of said container; and a liquid drain tube having an inlet inside said container at about the level of said liquid in said container, and an outlet outside said container.

4. An apparatus as recited in claim 3, wherein said inlet includes means for connecting to a reservoir of relatively unrecovered liquid, and wherein said outlet includes means for connecting to a reservoir of relatively recovered liquid.

5. An apparatus as recited in claim 1 wherein said power supply supplies a current density of a maximum of about 1.5 milliamperes per square inch, a level at which sulfiding and damage to the solution is extremely remote.

6. An apparatus as recited in claim 1 further comprising current regulator means, electrically connected between said power supply means and said electrodes, for regulating the amount of current passing from said power supply means to said electrodes.

7. An apparatus as recited in claim 6 wherein said current regulator means comprises indicator means for indicating that power is being supplied by said power supply and indicator means for indicating that current is not flowing between said electrodes.

8. A disposable cell for recovering conductive metal from a solution containing said conductive metal, comprising:

a disposable non-metallic container, having a thin film of said conductive metal applied to the interior thereof, and containing said liquid, said container being constructed of an easily refinable material when smelted with said metal;

an electrode removably affixed inside said container and insulated from said thin film;

a power supply having two poles, a positive pole and a negative pole, said positive pole being electrically connected to said electrode and said negative pole being removably electrically connected to said thin film, such that said metal becomes deposited on said thin film as it is recovered and, after recovery is sufficiently complete, said power supply and said electrode can be removed and the balance of the cell can be placed in a smelting furnace in its entirety, without further disassembly or removal of said metal from said container.

9. A cell as recited in claim 8 wherein said power supply supplies a current density of a maximum of about 1.5 milliamperes per square inch, a level at which sulfiding and damage to the solution is extremely remote.

10. A cell as recited in claim 9 further comprising means for circulating said liquid into and out of said container.

11. A cell as recited in claim 10 wherein said circulating means includes:

a liquid introduction tube having an inlet outside said container and an outlet within said container near the bottom of said container; and a liquid drain tube having an inlet inside said container at about the level of said liquid in said container, and an outlet outside said container.

12. A cell as recited in claim 11 further comprising current regulator means, electrically connected between said power supply and said electrode and film, for regulating the amount of current passing from said power supply means to said electrode.

13. A cell as recited in claim 12 wherein said current regulator means comprises indicator means for indicating that power is being supplied by said power supply and indicator means for indicating that current is not flowing between said electrode and said film.

14. A method for recovering a conductive metal from a solution containing said metal, comprising the steps of:

providing a disposable, electrically insulating container for containing said solution; said container being constructed of a material which is easily separated from said metal by smelting the container together with said metal recovered from said solution applying a thin film of said metal to the inside surface of said container;

removably affixing an electrode within said container so that said electrode is immersed in said liquid and insulated from said thin film;

raising the voltage potential of said electrode over that of said thin film, thereby causing said metal in said solution to be deposited on said film and build up thereon; and after said depositing and buildup are complete, removing said electrode from said container and placing said container, including said deposited metal, in a smelting furnace and smelting said metal.

15. A method as recited in claim 14 wherein said potential of said electrode is raised over that of said film sufficiently to cause a current density between said electrode and said film of a maximum of about 1.5 milliamperes per square inch, a level at which sulfiding and damage to the solution is extremely remote.

16. A method as recited in claim 15 wherein said potential of said electrode is raised over that of said film by about 1.5 volts.

17. A method as recited in claim 14 further comprising the step of:

providing means for circulating said liquid through said container.

18. A method as recited in claim 14 further comprising the step of:

circulating said liquid by introducing said liquid near the bottom of said container and withdrawing said liquid near the top of said container.

19. A method as recited in claim 14 further comprising the step of:

circulating said liquid through said container by means of stratified transport.

* * * * *